US006872093B2

(12) United States Patent
Fukatsu et al.

(10) Patent No.: US 6,872,093 B2
(45) Date of Patent: Mar. 29, 2005

(54) TERMINAL FITTING AND A CONNECTOR PROVIDED THEREWITH

(75) Inventors: Yukihiro Fukatsu, Yokkaichi (JP); Yuuichi Nankou, Yokkaichi (JP); Hideto Nakamura, Yokkaichi (JP); Ryotaro Ishikawa, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/408,868

(22) Filed: Apr. 7, 2003

(65) Prior Publication Data

US 2003/0190842 A1 Oct. 9, 2003

(30) Foreign Application Priority Data

Apr. 8, 2002 (JP) ..... 2002-105084

(51) Int. Cl.[7] ..... H01R 13/40
(52) U.S. Cl. ..... 439/595; 439/752
(58) Field of Search ..... 439/752, 752.5, 439/595

(56) References Cited

U.S. PATENT DOCUMENTS 4,867,712 A * 9/1989 Kato et al. ..... 439/752
5,226,839 A * 7/1993 Koumatsu et al. ..... 439/595
5,464,356 A * 11/1995 Nebeshima et al. ..... 439/752
5,626,499 A * 5/1997 Yagi et al. ..... 439/752.5
6,227,915 B1 * 5/2001 Sakatani et al. ..... 439/852
6,264,507 B1 * 7/2001 Fukamachi ..... 439/752
6,375,501 B1 * 4/2002 Kojima ..... 439/595
6,390,860 B2 * 5/2002 Shirouzu et al. ..... 439/752.5
2003/0100230 A1 * 5/2003 Tsuji et al. ..... 439/752

FOREIGN PATENT DOCUMENTS

JP 2001-332334 11/2001
JP 2003297490 A * 10/2003 ..... H01R/13/642

* cited by examiner

*Primary Examiner*—Hae Moon Hyeon
(74) *Attorney, Agent, or Firm*—Gerald E. Hespos; Anthony J. Casella

(57) ABSTRACT

A terminal fitting (10) has a main body (11) and stabilizer (17) for preventing upside-down insertion stands up from a surface of the main body (11). Elongated projections (50) extend from a surface of the main body (11) opposite the stabilizer (17). If the male terminal fitting (10) is inserted upside down, the elongated projections (50) contact a bottom wall (24B) at the entrance of a cavity (24) during the insertion to shift the male terminal fitting (10) transversely. Thus, the stabilizer (17) is caught deeply by a ceiling wall (24C) at the entrance. As a result, the male terminal fitting (10) is prevented from any further insertion.

10 Claims, 14 Drawing Sheets

TERMINAL FITTING AND A CONNECTOR PROVIDED THEREWITH

BACKGROUND OF THE INVENTION

1. Field of the Invention

The invention relates to a terminal fitting and to a connector having a function of preventing the upside-down insertion of a terminal fitting.

2. Description of the Related Art

Japanese Unexamined Patent Publication No. 2001-332334 discloses a connector with cavities, and terminal fittings are insertable into cavities from behind. Each terminal fitting has a main body, and a stabilizer projects from one side edge of the bottom surface of the main body. An insertion path is formed in the bottom wall of each cavity for permitting insertion of the stabilizer. An attempt could be made erroneously to insert the terminal fitting upside down into the cavity. In this situation, the stabilizer contacts the edge of the ceiling at the entrance to the cavity to prevent any further insertion. Thus, upside-down insertion of the terminal fitting can be prevented.

A difference between the height of the cavities and the height of the main bodies of the terminal fittings may be larger than a tolerance in some connectors. For example, a connector may have crimped terminal fittings and insulation-displacement terminal fittings. The height of the cavities may be sufficiently large to permit insertion of a jig for the insulation-displacement terminal fitting.

FIG. 14 shows a known terminal fitting 1 inserted upside down into a cavity that has a height slightly greater than a specified height. In this situation, a stabilizer 2 may not be caught sufficiently by the opening edge of the cavity and the terminal fitting 1 may slip into the entrance of the cavity. Accordingly, an upside-down insertion preventing function may not be displayed.

The invention was developed in view of the above problem and an object is to provide a terminal fitting that prevents upside-down insertion.

SUMMARY OF THE INVENTION

The invention relates to a terminal fitting with a main body and at least one stabilizer projecting on a surface of the main body. At least one projection is provided on a surface of the main body substantially opposite from the surface that has the stabilizer. The projection is at a position substantially opposed to the stabilizer along the longitudinal direction of the terminal fitting.

The projection contacts the opening edge of the entrance of the cavity and shifts the terminal fitting transversely if the terminal fitting is inserted upside down. Thus, the stabilizer is caught deeply by the opening edge of the entrance at the side opposite the projection. As a result, the upside-down insertion of the terminal fitting is prevented.

At least two projections preferably are provided substantially side by side along the widthwise direction of the terminal fitting. Thus, the terminal fitting is prevented from rotating about its longitudinal axis in the cavity.

The projection preferably is elongated along the longitudinal direction of the terminal fitting.

The projection preferably is at a position along the longitudinal direction substantially corresponding to a position of an engaging portion provided for engagement with a side type retainer.

The projection preferably is spaced back from the front end of the terminal fitting along the longitudinal direction.

The invention also relates to a connector with a housing that has at least one cavity and at least one of the above-described terminal fittings. An insertion path is formed in a wall of the cavity and is dimensioned to receive the stabilizer when a properly oriented terminal fitting is inserted into the cavity.

The projection of the terminal fitting contacts the opening edge of the entrance of the cavity to shift the terminal fitting transversely if the terminal fitting is inserted upside down into the cavity. Thus, the stabilizer is caught deeply by the opening edge of the entrance at the opposite side. As a result, the upside-down insertion of the terminal fitting is prevented.

A distance between the wall surface that has the insertion path and a wall surface substantially facing it at the front end of the cavity preferably is narrowed to hold the front end of the terminal fitting tightly and to prevent shaking. Additionally, the portion of the terminal fitting that has the projection and the stabilizer is held tightly held between the opposed wall surfaces. Thus, the terminal fitting is held securely at both the front end and the rear end where the projection is provided.

A retainer for locking the terminal fitting in the cavity preferably is insertable from the side of the wall of the cavity that has the insertion path. Thus, the terminal fitting is shifted transversely in the cavity in a direction substantially opposite from the inserting direction of the retainer. Accordingly, a larger engaging area of the retainer with the terminal fitting is achieved, thereby obtaining a larger locking force.

The insertion path preferably extends to a position slightly forward from the front end of a retainer insertion hole into which the retainer is inserted.

A wall of each cavity preferably has a lock for locking the terminal fitting in the cavity, and the main body of the terminal fitting is held resiliently and tightly between a shake-preventing portion of the lock and a bulge on a wall of the cavity substantially facing the wall that has the lock.

These and other objects, features and advantages of the invention will become more apparent upon reading of the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 1:
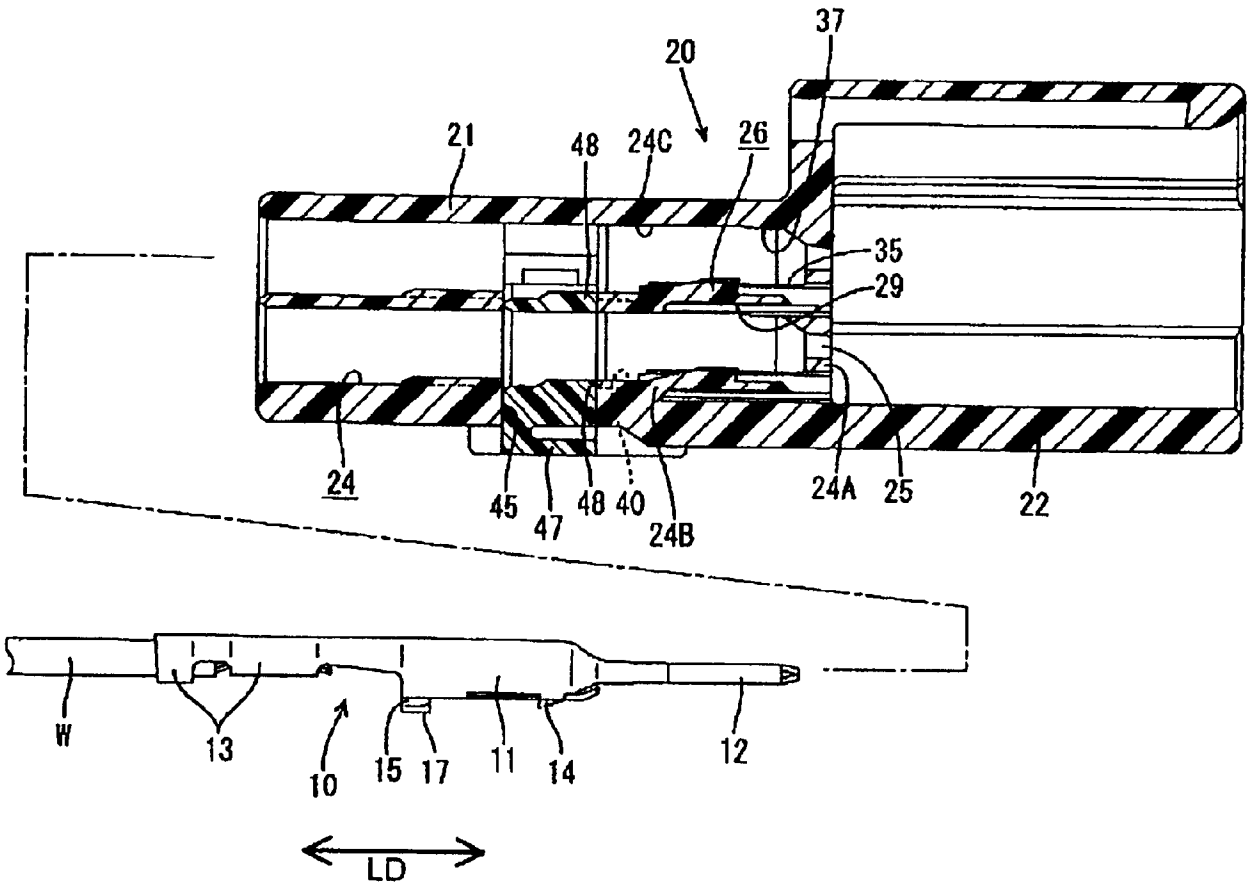
FIG. 1 is a longitudinal sectional view of a connector according to the invention, and showing a state before a male terminal fitting is inserted.

A male connector according to the invention includes male terminal fittings 10, as shown in FIGS. 1 to 5. Each male terminal fitting 10 has a rectangular tubular main body 11 and a tab 12 that projects forward from the main body 11. Crimping barrels 13 are at the rear of the main body 11 and are configured for connection with an end of a wire W.

Figure 2:
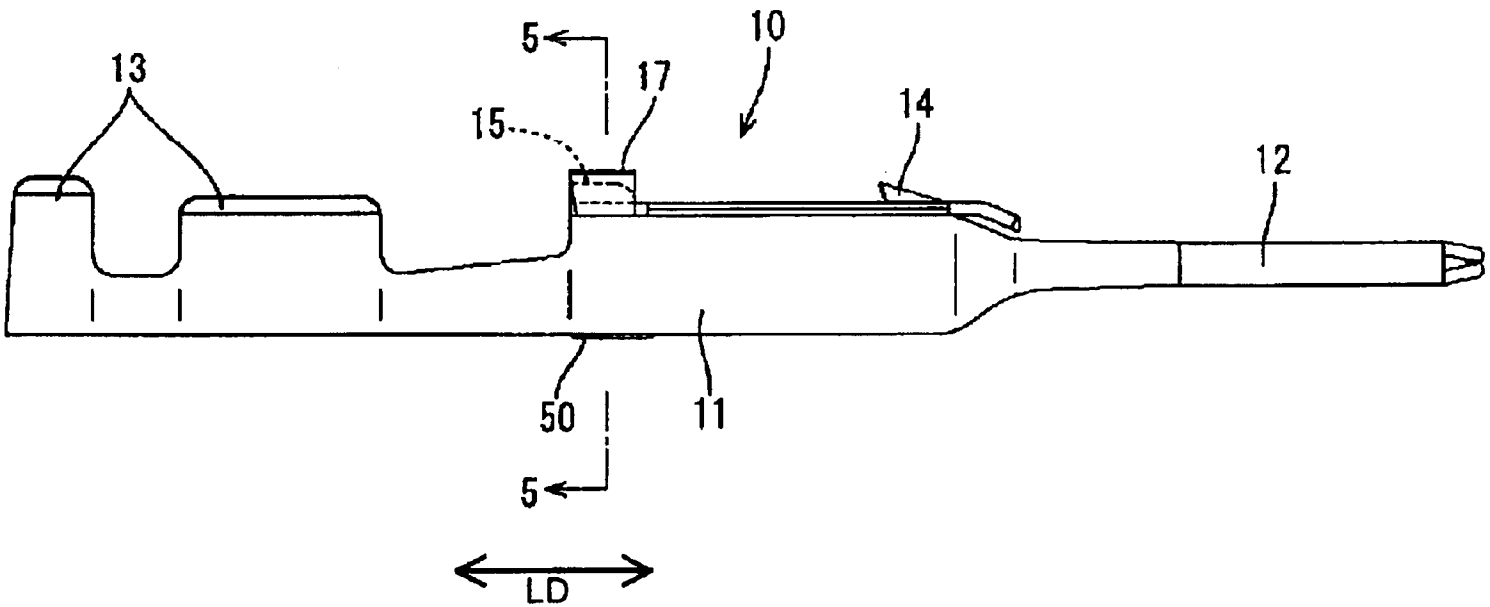
FIG. 2 is a side view of the male terminal fitting.
Figure 3:
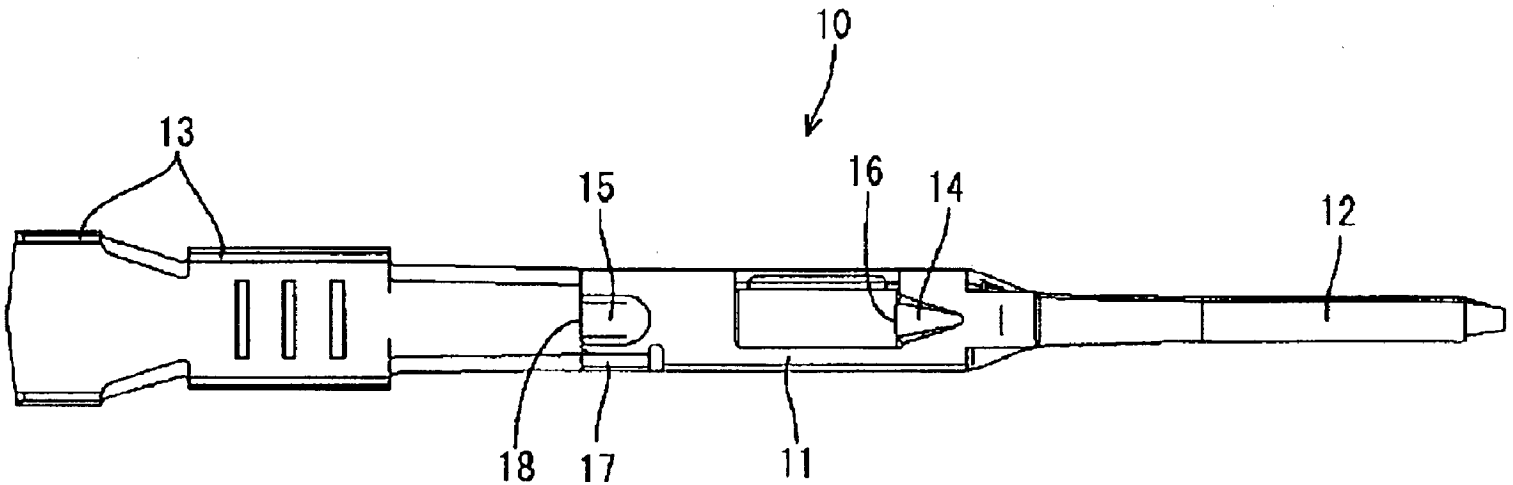
FIG. 3 is a plan view of the male terminal fitting.
Figure 5:
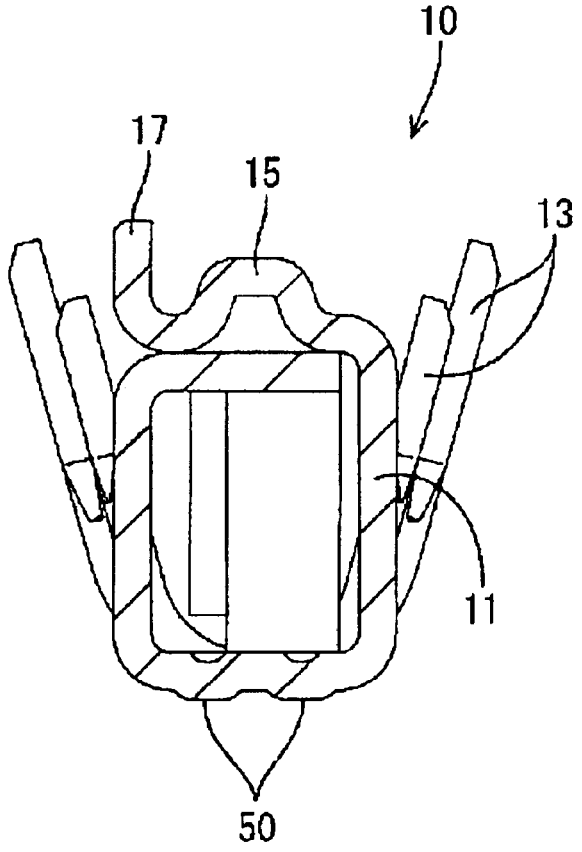
FIG. 5 is an enlarged sectional view along 5—5 of FIG. 2.

First and second engaging portions 14 and 15 project from the upper surface of the main body 11 as shown in FIGS. 2 and 5. The first engaging portion 14 is distanced slightly from the leading end of the upper surface and the second engaging portion 15 is at the rear end thereof. A recess 16 is formed behind the first engaging portion 14 and between the first and second engaging portions 14, 15 (FIG. 3). Further, a stabilizer 17 stands up at one edge of the rear end of the upper surface of the main body 11.

The connector also includes a housing 20 formed e.g. of a synthetic resin. The housing 20 has a main body 21 with a receptacle 22 into which a mating female connector housing (not shown) is fittable. Cavities 24 are arranged in upper and lower stages in the main body 21 and extend forward and backward. Each cavity 24 has a front wall 24A and a terminal insertion opening 25 extends through each front wall 24A. Each cavity 24 is configured to accommodate one of the male terminal fittings 10 so that the tab 12 of the male terminal fitting 10 passes through the terminal insertion opening 25. A lock 26 is provided at a front end of a bottom wall 24B of each cavity 24 for partly locking the male terminal fitting 10 that has been properly inserted. The bottom walls 24B of the cavities 24 at the upper stage also are ceiling walls 24C of the cavities 24 at the lower stage.

Figure 6:
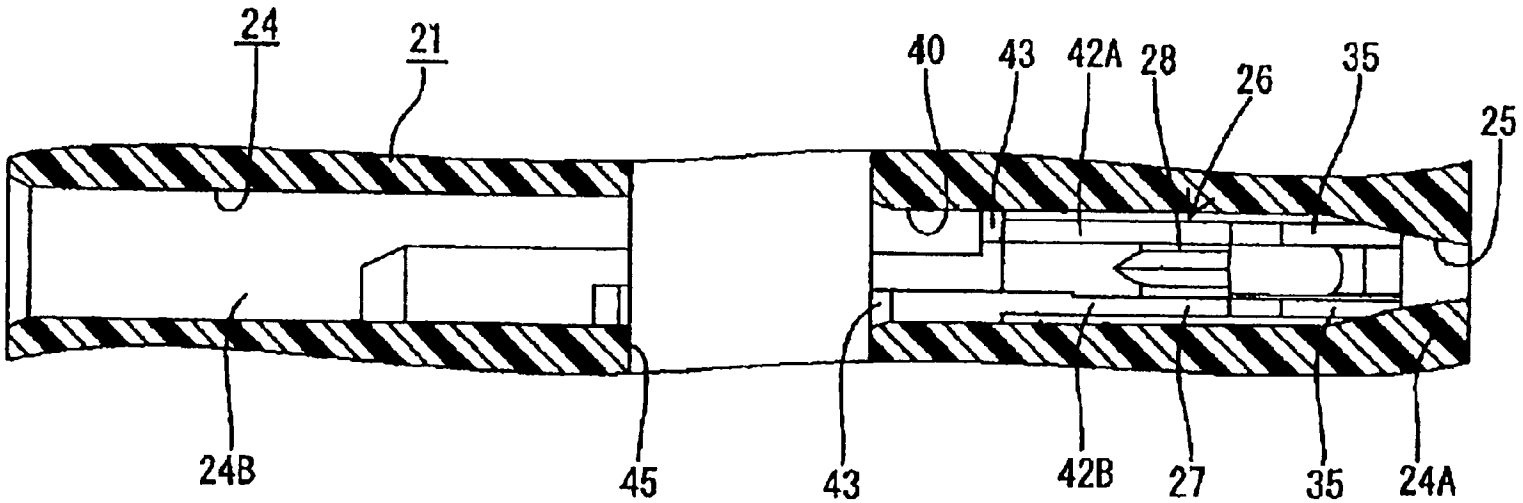
FIG. 6 is a horizontal sectional view of the connector housing.
Figure 8:
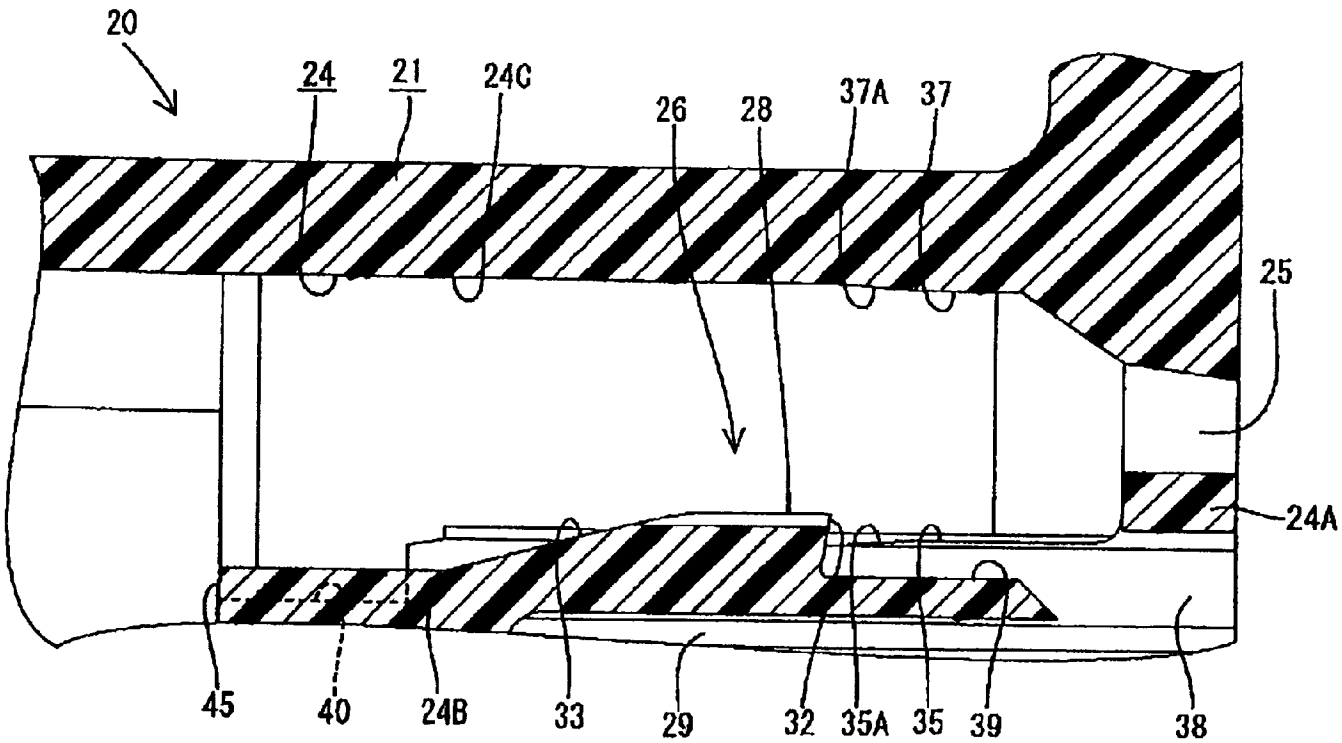
FIG. 8 is a vertical sectional view of the housing.

The lock 26 of each upper stage cavity 24 has an arm 27 supported at both front and rear ends, as shown in FIGS. 6 and 8. An engaging section 28 is formed on the upper surface of the arm 27 and faces into the cavity 24 for engaging the first engaging portion 14 of the male terminal fitting 10.

The arm 27 is slightly narrower than the cavity 24 and is resiliently deformable along a vertical direction that intersects an inserting direction of the male terminal fitting 10 into the cavity 24. A groove-shaped deformation permitting space 29 opens in the ceiling of the cavity 24 at the lower stage and in the bottom wall 24B below the arm 27. The deformation permitting space 29 (FIG. 1) permits the resilient deformation of the lock 26.

A groove 31 is formed at a widthwise middle of the upper surface of the arm 27 and the engaging section 28 is substantially at a longitudinal middle of the bottom of the groove 31. The engaging section 28 projects slightly from the upper surface of the arm 27, and is engageable with the first engaging portion 14 and the recess 16 of the male terminal fitting 10 substantially over the entire height. An engaging surface 32 is at the front of the engaging section 28 and is undercut so that the upper end is more forward. A guiding surface 33 is formed on the rear of the engaging section 28 and slants down to the back.

The rear of the arm 27 is coupled to the bottom wall 24B over its entire width. However, the front of the arm 27 is forked and coupled to the front wall 24A on opposite sides of the groove 31. An elevated shake-preventing portion 35 is formed on the upper surface of the front end of the forked portion of the arm 27 and includes a moderately sloped section 35A.

A bulge 37 bulges down from the front of the ceiling wall 24C of the cavity 24, and has a moderately sloped surface 37A, as shown in FIG. 8. The front of the main body 11 of the male terminal fitting 10 is held closely and tightly between the bulge 37 and the shake-preventing portion 35.

A jig insertion opening 38 is formed in the front wall 24A for inserting a disengaging jig. An operable surface 39 is formed in the bottom of the groove 31 before the engaging section 28 and can be pushed down by the disengaging jig to deform the lock 26 away from the inserted terminal fitting 10.

Figure 7:
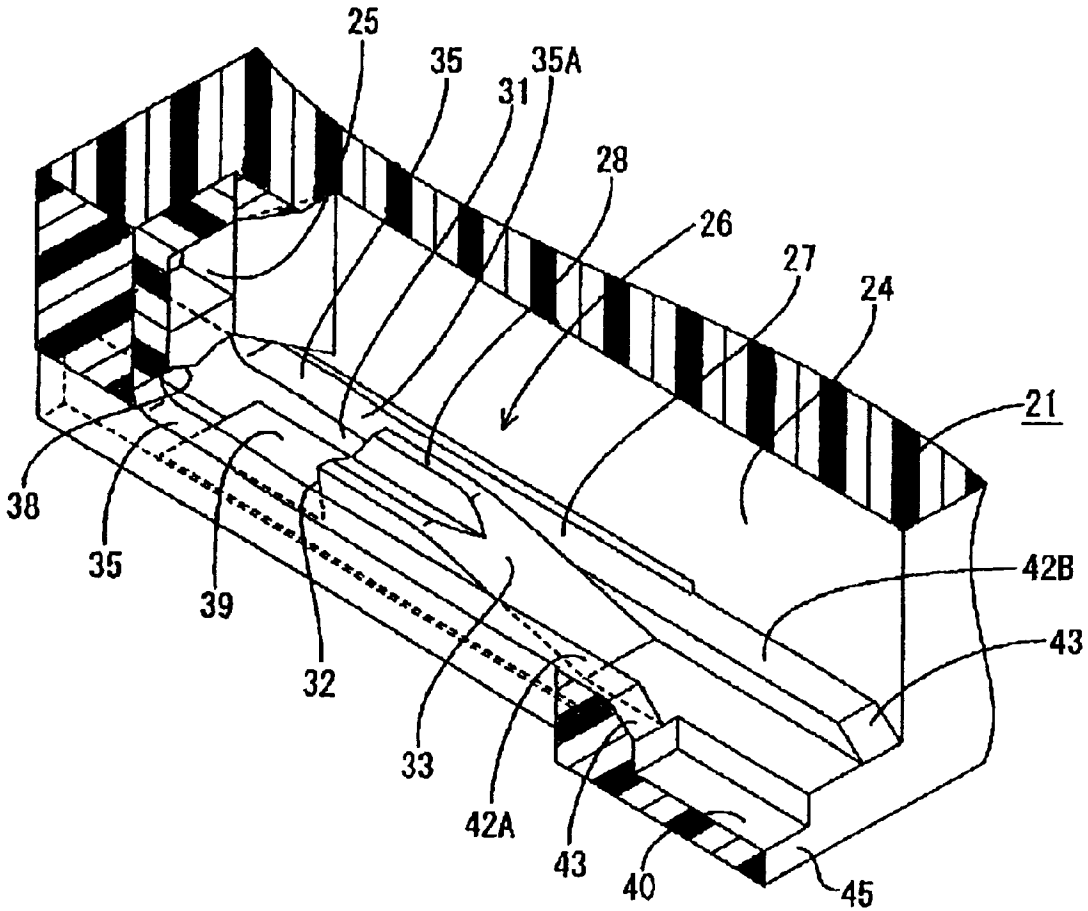
FIG. 7 is a perspective view of the housing, partly in section.

An insertion path 40 for guiding the stabilizer 17 of the male terminal fitting 10 is formed at the left side of the bottom wall 24B of the cavity 24 when viewed from behind, as shown in FIGS. 6 and 7. Sides 42A, 42B of the arm 27 of the lock 26 at the opposite sides of the groove 31 are raised slightly. The rear surface of the side 42A at the left side when viewed from behind is more forward due to the presence of the insertion path 40. Slanted guiding surfaces 43 are defined at the rear surfaces of the left and right sides 42A, 42B.

The locks 26 of the cavities 24 at the lower stage are shaped similar to the locks 26 at the upper stage described above.

Figure 13:
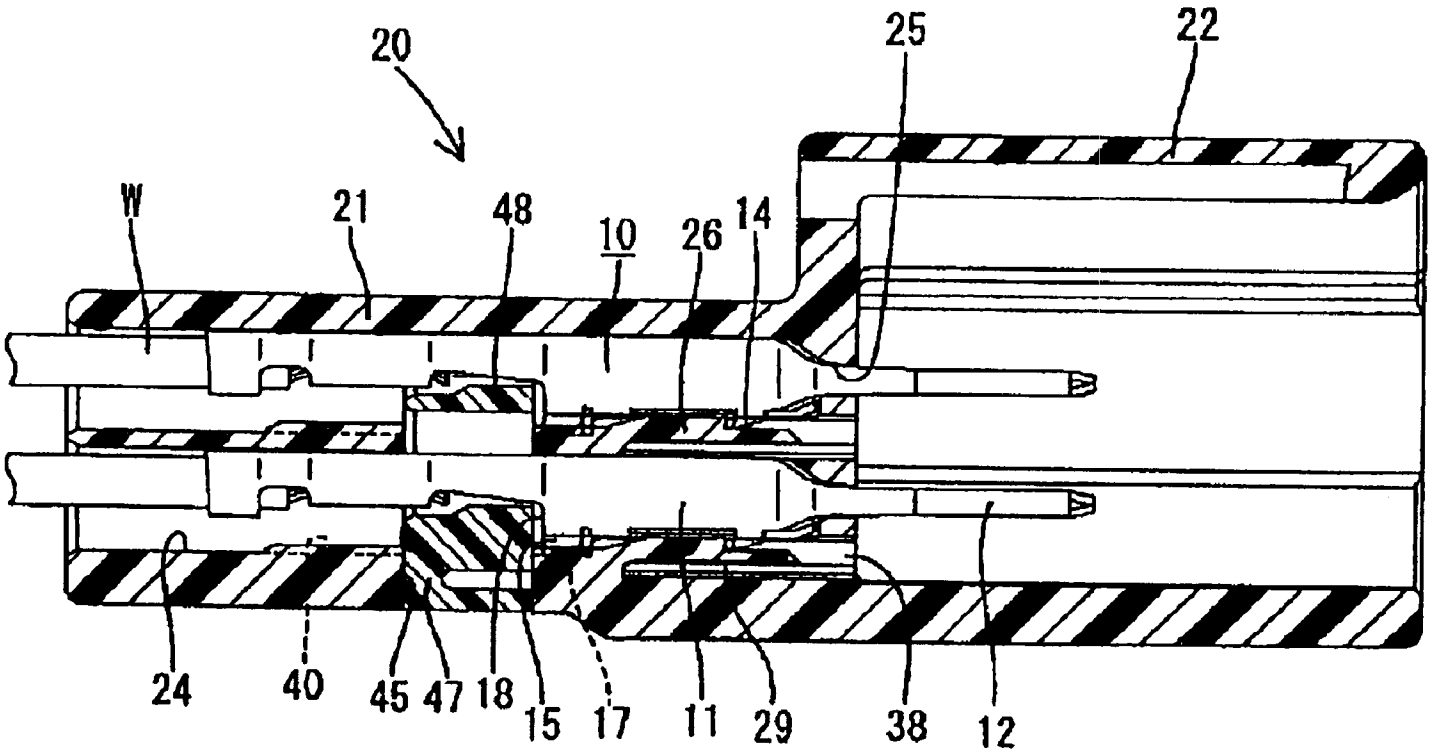
FIG. 13 is a longitudinal sectional view showing a state where a retainer is inserted to a full locking position.
Figure 14:
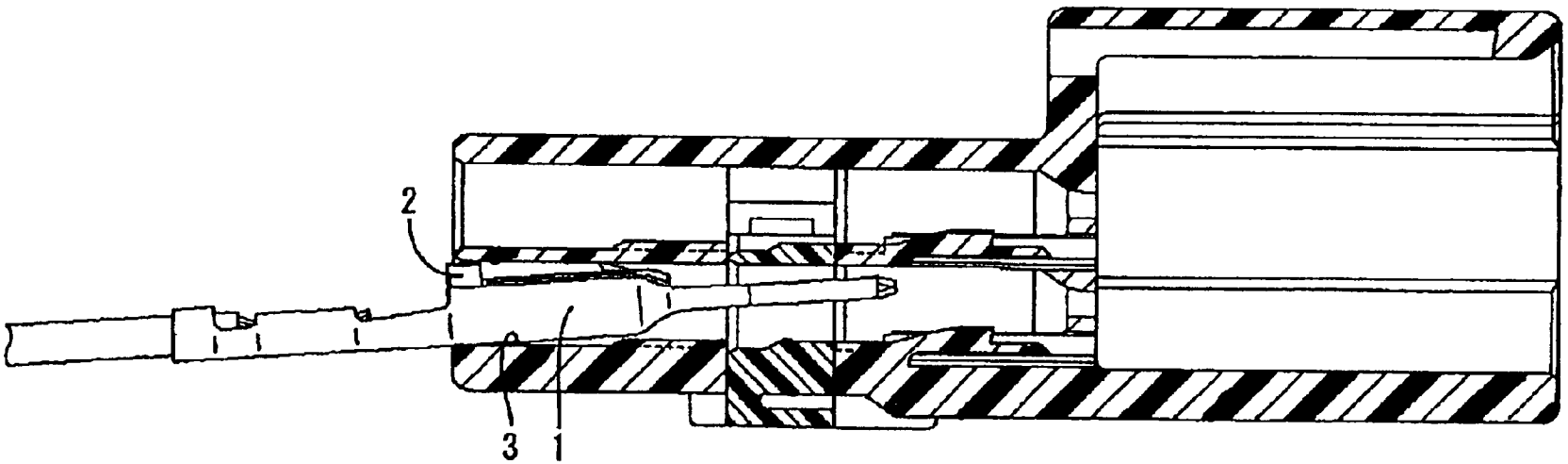
FIG. 14 PRIOR ART
FIG. 14 is a longitudinal sectional view of a prior art connector.

A retainer insertion hole 45 is formed in the bottom surface of the main body 21 at a position behind the locks 26 and penetrates the cavities 24 at the upper and lower stages. A retainer 47 is insertable vertically into the retainer insertion hole 45 and is formed with fasteners 48 arranged at the two stages. Each fastener 48 is engageable with the corresponding male terminal fitting 10 from the second engaging portion 15 to a jaw 18. The retainer 47 can be pushed from a partial locking position (FIG. 1) to a full locking position (FIG. 13). The fasteners 48 are below the corresponding cavities 24 when the retainer 47 is in the partial locking position to permit insertion and withdrawal of the male terminal fittings 10 into and from the cavities 24. However, the fasteners 48 enter the corresponding cavities 24 from below to lock the terminal fittings 10 when the retainer 47 is in the full locking position.

Figure 4:
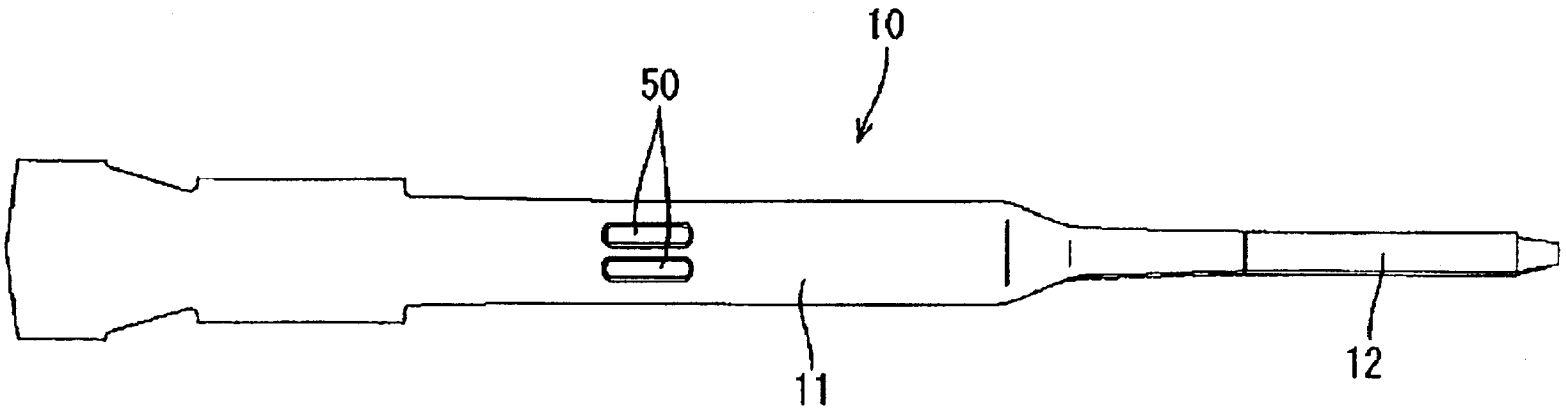
FIG. 4 is a bottom view of the male terminal fitting.

Two elongated projections 50 extend along a longitudinal direction LD on the outer bottom surface of the main body 11 of the male terminal fitting 10, which is a side of the main body 11 opposite to the second engaging portion 15. Specifically, as shown in FIGS. 2, 4 and 5, the projections 50 are formed by embossing or cutting and bending the outer bottom surface of the main body 11 to extend substantially parallel to each other at a position substantially right below the stabilizer 17 with respect to longitudinal directions and/or at a widthwise middle portion. Opposite front and rear ends of the elongated projection 50 are rounded.

The elongated projections 50 have a height set such that a portion of the terminal fitting 10 that has the stabilizer 17 and the elongated projections 50 can be fit closely into the cavity 24 between the ceiling wall 24C located immediately before the bulge 37 and the sloped surface 37A, and the insertion path 40 for the stabilizer 17.

The connector is assembled by inserting the retainer 47 into the retainer insertion hole 45 to the partial locking position, as shown in FIG. 1. Each male terminal fitting 10 then is inserted into the corresponding cavity 24 from behind.

Figure 9:
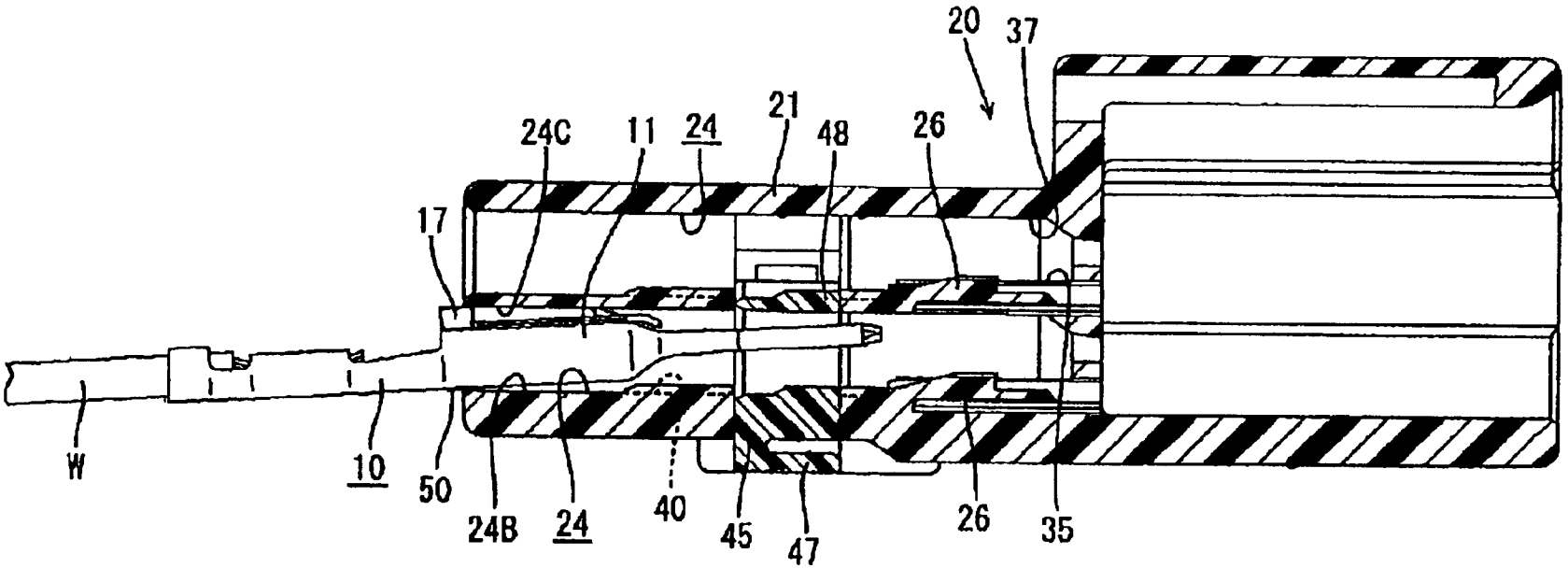
FIG. 9 is a longitudinal sectional view showing a state where upside-down insertion of the male terminal fitting is detected.
Figure 10:
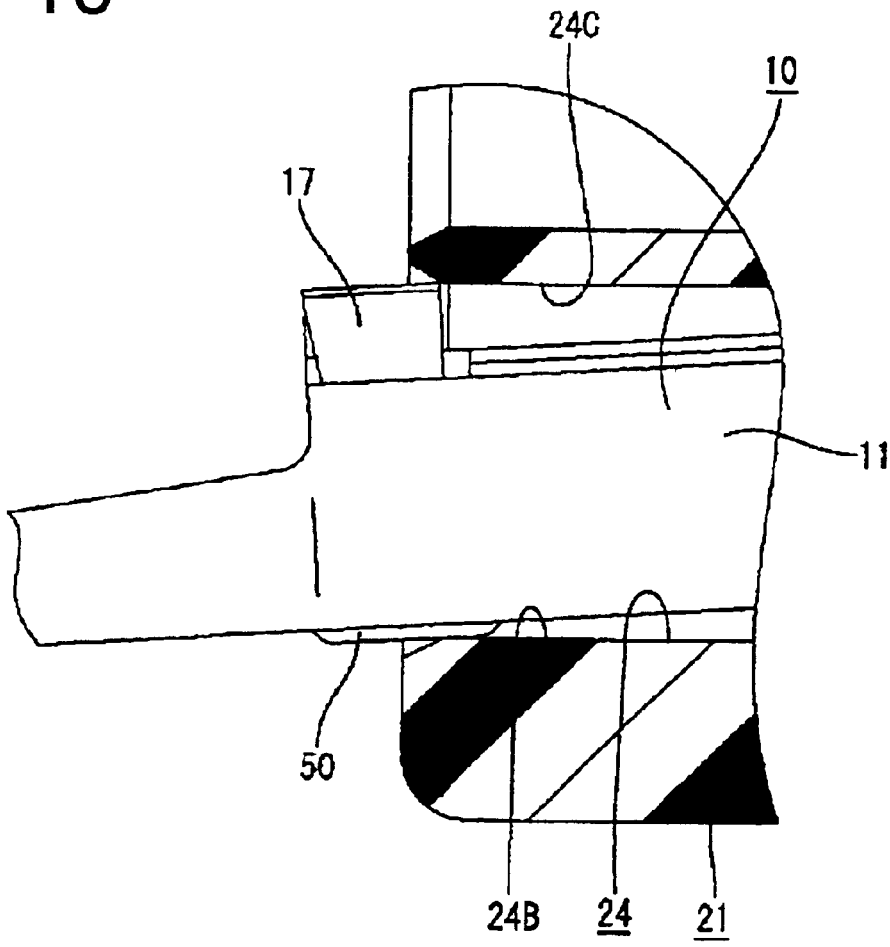
FIG. 10 is a fragmentary enlarged view of FIG. 9.

The male terminal fitting 10 could be inserted upside down, as shown in FIG. 9. As a result, the stabilizer 17 will contact the ceiling wall 24C at the entrance of the cavity 24 and the elongated projections 50 will contact with the bottom wall 24B at the entrance of the cavity 24, as shown in FIG. 10. The elongated projections 50 will raise the male terminal fitting 10 and urge the stabilizer 17 deeply into the ceiling wall 24C at the entrance. As a result, the male terminal fitting 10 is prevented from further insertion and the upside-down orientation of the male terminal fitting 10 is detected. The male terminal fitting 10 then is turned to the proper orientation and inserted into the cavity 24 again.

The stabilizer 17 of the properly oriented male terminal fitting 24 enters the insertion path 40 as the male terminal fitting 10 is inserted into the cavity 24. The main body 11 then moves onto the opposite sides 42A, 42B of the arm 27 of the lock 26, and the leading end of the main body 11 contacts the guiding surface 33 of the engaging section 28. Sufficient insertion of the male terminal fitting 10 moves the leading end of the main body 11 and the first engaging portion 14 past the upper surface of the engaging section 28 and deforms the lock 26 resiliently into the deformation permitting space 29.

Figure 11:
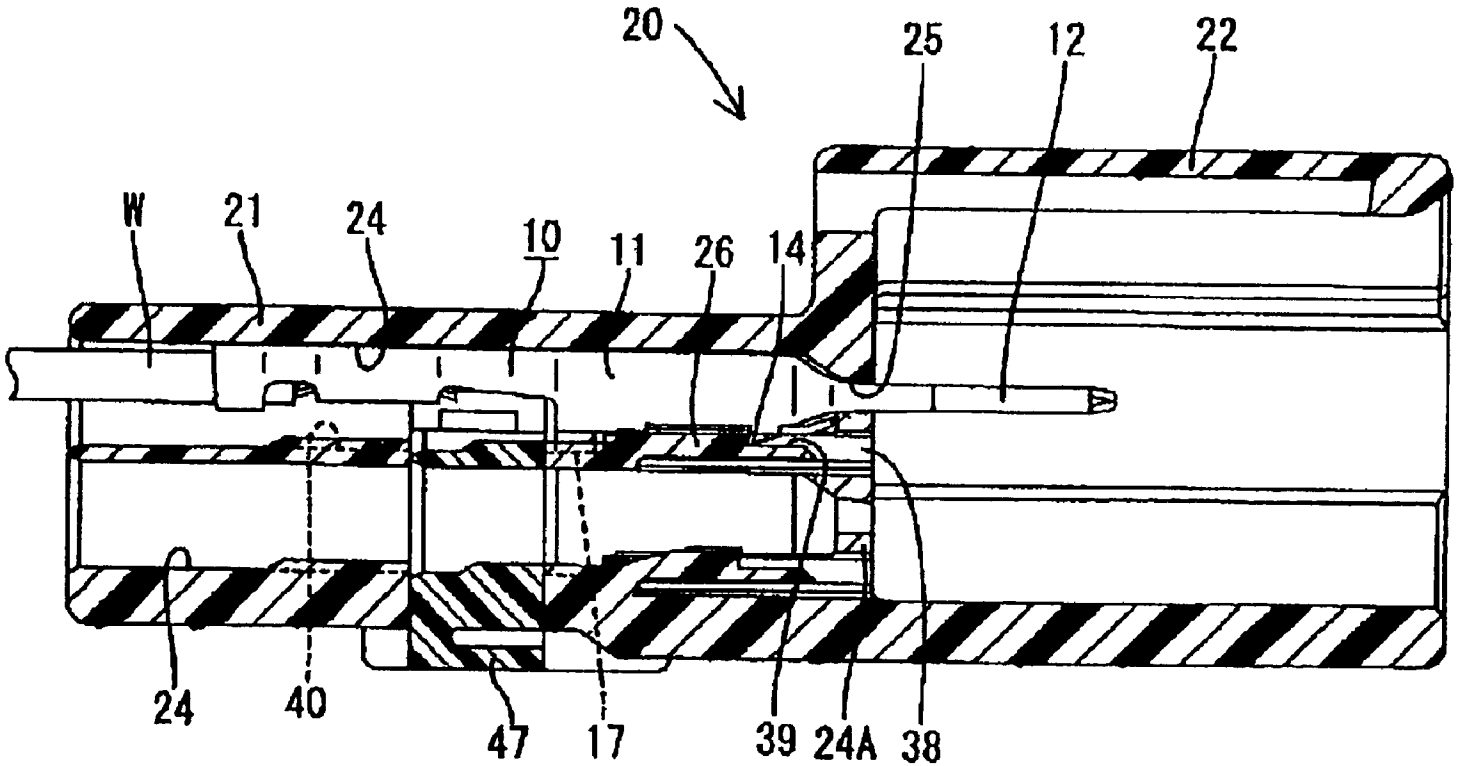
FIG. 11 is a longitudinal sectional view showing a state where the male terminal fitting is properly inserted.

The first engaging portion 14 passes the engaging section 28 of the lock 26 and the main body 11 contacts the front wall 24A of the cavity 24 when the male terminal fitting 10 is inserted completely. Thus, the lock 26 is restored to its original shape, and the engaging surface 32 of the engaging section 28 engages the first engaging portion 14 and the front edge of the recess 16, as shown in FIG. 11 for partially locking the male terminal fitting 10.

Figure 12:
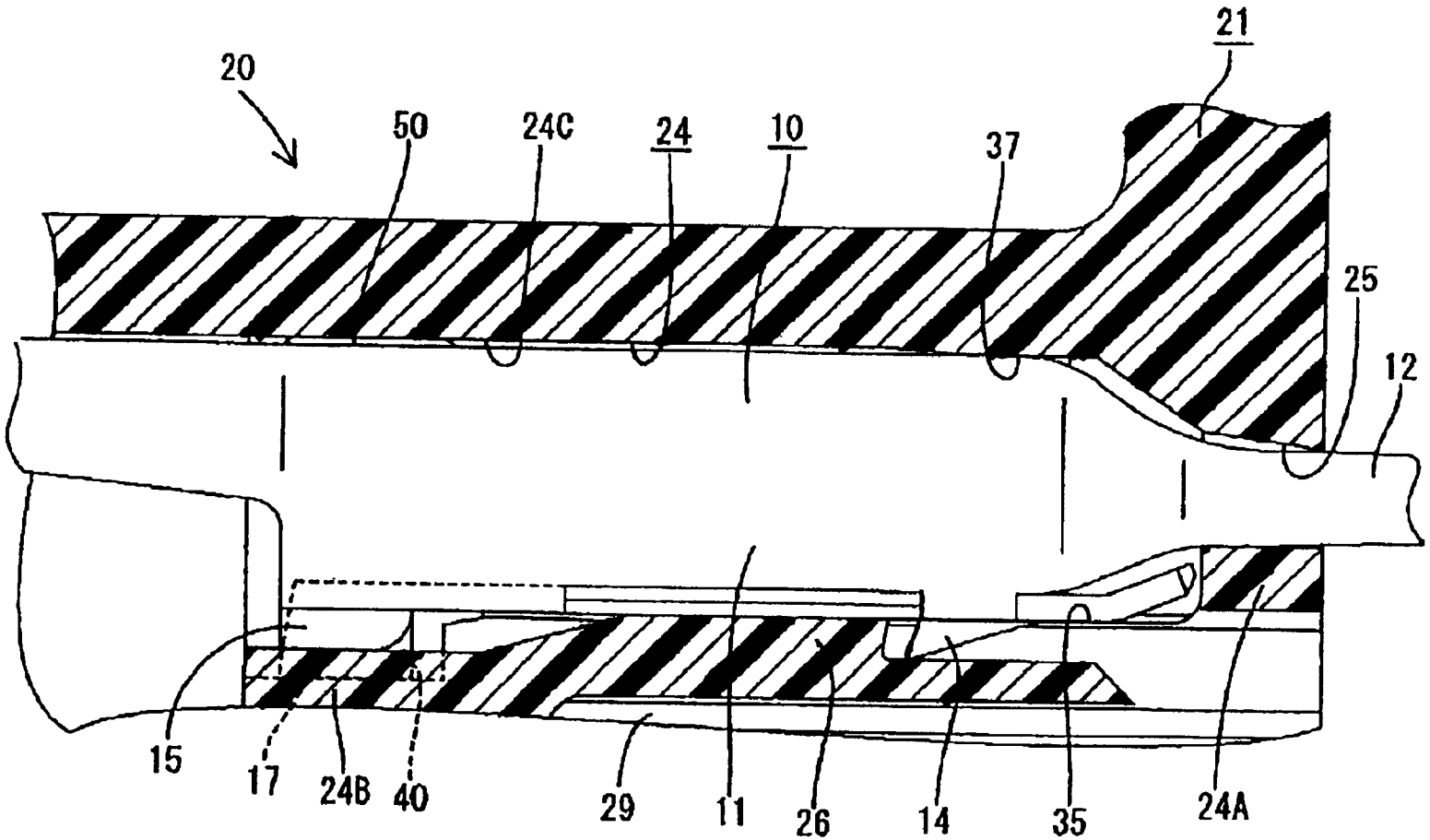
FIG. 12 is a fragmentary enlarged view of FIG. 11.

At this time, the main body 11 of the male terminal fitting 10 contacts the bulge 37 of the ceiling wall 24C and is pushed toward the bottom wall 24B of the cavity 24, as shown in FIG. 12. Additionally, the lock 26 is restored toward its original shape as described above, and the front end of the main body 11 is held tightly held between the shake preventing portion 35 of the lock 26 and the bulge 37 of the ceiling wall 24C.

The rear end of the main body 11 is provided with the elongated projections 50 and the stabilizer 17 and is fit closely into the cavity 24 between the ceiling wall 24C and the insertion path 40. In this way, the male terminal fitting 10 is accommodated in the cavity 24 and is prevented from shaking along vertical direction at front and rear positions.

The retainer 47 is pushed to the full locking position as shown in FIG. 13 after all the terminal fittings 10 are inserted into the cavities 24. Each fastening portion 48 then enters the corresponding cavity 24 to engage the second engaging portion 15 and the rear side of the jaw 18 of the male terminal fitting 10. Thus, the male terminal fitting 10 is locked doubly.

At this time, the elongated projections 50 come substantially into contact with the ceiling wall 24C, whereby the main body 11 of the male terminal fitting 10 is pushed in a downward direction opposite from the pushing direction of the retainer 47. Thus, the fastener 48 of the retainer 47 is engaged deeply with the second engaging portion 15 and the jaw 18, thereby reinforcing a locking force of the retainer 47.

The male terminal fitting 10 may have to be withdrawn from the housing 20 for maintenance or other reason. In such a case, the retainer 47 is returned from the full locking position to the partial locking position (see FIG. 11). The disengaging jig then is brought into the receptacle 22 and is inserted through the jig insertion opening 38 of the front wall 24*a* of the cavity 24 to engage the operable surface 39 and push the lock 26 down and away from the terminal fitting 10. The lock 26, therefore, is disengaged from the first engaging portion 14 and the recess 16 of the male terminal fitting 10. The male terminal fitting 10 can be withdrawn from the cavity 24 by pulling on the wire W.

The male terminal fitting 10 may be oriented upside down for insertion into the cavity 24. However, the elongated projections 50 contact the bottom wall 24B at the entrance of the cavity 24 to shift the male terminal fitting 10 transversely, and the stabilizer 17 is caught deeply by the ceiling wall 24C at the entrance. As a result, the male terminal fitting 10 is prevented from the upside-down insertion.

The elongated projections 50 and the stabilizer 17 of a properly oriented male terminal fitting 10 fit closely into the cavity 24 at front and rear positions to prevent the male terminal fitting 10 from shaking. As a result, the male terminal fitting 10 is held securely in position.

The two elongated projections 50 are provided substantially side by side in the widthwise direction. Thus, the male terminal fitting 10 is prevented from rotating about its longitudinal axis in the cavity 24.

The male terminal fitting 10 is pushed down in the cavity opposite from the inserting direction of the retainer 47. Thus, a larger engaging area of the fastening portion 48 of the retainer 47 with the male terminal fitting 10 can be ensured, thereby obtaining a larger double locking force.

The invention is not limited to the above-described embodiment. For example, the following embodiments also are embraced by the technical scope of the invention as defined in the claims. Various changes can be made without departing from the scope of the invention as defined in the claims.

One, three or more elongated projections may be provided.

The invention is similarly applicable to a female connector in which female terminal fittings are accommodated.

What is claimed is:

1. A terminal fitting for insertion into a cavity of a connector housing, the connector housing further having a retainer insertion hole extending transverse to the cavity and configured for receiving a side-type retainer that retainers the terminal filling that has been inserted properly into the cavity, the terminal fitting comprising:

a main body with opposite front and rear ends and opposite first and second surfaces extending at least partly between the ends, a first engaging portion projecting from the first surface of the main body, at least one stabilizer projecting on the first surface of the main body rearward of the first engaging portion, a second engaging portion at a rear end of the stabilizer for engagement with a side-type retainer, and at least one projection provided on the second surface of the main body at a position substantially opposite the stabilizer along a longitudinal direction of the terminal filling, whereby the at least one projection urges the stabilizer of an improperly oriented terminal filling into a position for more securely preventing insertion into the cavity of the connector housing, and whereby the projection urges a properly oriented terminal filling into more secure engagement with the retainer.

2. The terminal fitting of claim 1, wherein the at least one projection comprises a plurality of the projections provided substantially side by side along a widthwise direction of the terminal filling.

3. The terminal fitting of claim 1, wherein the at least one projection is elongated along the longitudinal direction.

4. The terminal fitting of claim 1, wherein the at least one projection has a rounded front end.

5. The terminal fitting of claim 1, wherein the projection is at a position displaced back from the front end of the terminal fitting.

6. A connector, comprising:

a housing with at least one cavity;

at least one terminal fitting insertable into the cavity, the terminal fitting having a main body with opposite front and rear ends and opposite first and second surfaces extending between the ends, at least one stabilizer projecting on the first surface of the main body, a first engaging portion rearward of the stabilizer and at least one projection provided on the second surface of the main body at a position substantially opposite the stabilizer along a longitudinal direction of the terminal fitting;

an insertion path formed in a first wall surface of the cavity and dimensioned to permit the insertion of the stabilizer;

a retainer insertion hole extending through the first wall surface and into the cavity; and a retainer insertable into the retainer insertion hole for locking the terminal fitting in the cavity, whereby the at least one projection urges an improperly oriented terminal fitting into a second wall surface of the cavity, and whereby the at least one projection urges a properly oriented terminal filling towards the retainer insertion hole for more secure engagement by the retainer.

7. The connector of claim 6, wherein a distance between the wall surface formed with the insertion path and an opposed wall surface at a front end of the cavity is narrowed by a bulge to prevent the terminal fitting from shaking by tightly holding a front end of the terminal fitting.

8. The connector of claim 6, wherein the insertion path extends to a position more forward than a front end of the retainer insertion hole.

9. The connector of claim 6, wherein a wall surface of each cavity has a lock for locking the terminal fitting in the cavity, and wherein the main body of the terminal fitting is held resiliently and tightly between the lock and a bulge provided on a wall surface of the cavity substantially facing the wall surface with the lock.

10. The connector of claim 6, wherein the at least one projection has a rounded front end.

* * * * *